US005850062A

United States Patent [19]

Botz et al.

[11] Patent Number: 5,850,062

[45] Date of Patent: Dec. 15, 1998

[54] PLURAL SWITCH CONFIGURATION IN A RECESSED SWITCH HOUSING WITH AN ILLUMINATED ROCKER AND FLOATINGLY MOUNTED ACTUATION CAP

[75] Inventors: Jakob Botz, Ingershein; Berthold Fein; Adam Weber, both of Bietigheim-Bissingen, all of Germany

[73] Assignee: ITT Automotive Automotive GmbH, Frankfurt am Main, Germany

[21] Appl. No.: 718,407

[22] PCT Filed: Mar. 22, 1995

[86] PCT No.: PCT/EP95/01063

§ 371 Date: Nov. 18, 1996

§ 102(e) Date: Nov. 18, 1996

[87] PCT Pub. No.: WO95/26564

PCT Pub. Date: Oct. 5, 1995

[30] Foreign Application Priority Data

Mar. 28, 1994 [DE] Germany ..... 44 10 697.1

[51] Int. Cl.[6] ..... H01H 3/07; H01H 9/18; H01H 23/02

[52] U.S. Cl. ..... 200/315; 200/339; 200/553

[58] Field of Search ..... 200/1 R, 5 R, 200/5 A, 6 R, 308–317, 339, 341–345, 553–562

[56] References Cited

U.S. PATENT DOCUMENTS

| | | | |
|---|---|---|---|
| 4,797,520 | 1/1989 | Spazlerer et al. | 200/4 X |
| 5,187,336 | 2/1993 | Lang et al. | 200/61.61 |

FOREIGN PATENT DOCUMENTS

| | | |
|---|---|---|
| 1558448 | 2/1969 | France . |
| 3932872 | 5/1991 | Germany . |
| 4115741 | 11/1992 | Germany . |
| 4214794 | 11/1993 | Germany . |

*Primary Examiner*—J. R. Scott
*Attorney, Agent, or Firm*—Plevy & Associates

[57] ABSTRACT

The invention relates to a switch configuration that can be used in a receptacle that is equipped with a shield. In this case, the shield can be arranged offset relative to the receptacle within the framework of given tolerances. The novel switch arrangement is used to compensate for the offset of the shield relative to the receptacle with the aid of a cap that is mounted in a floating manner. In this case, the friction of an actuation cap, which actuates a switch via an actuator, is to be kept as low as possible relative to the guide surfaces of the corresponding shield opening.

20 Claims, 2 Drawing Sheets

PLURAL SWITCH CONFIGURATION IN A RECESSED SWITCH HOUSING WITH AN ILLUMINATED ROCKER AND FLOATINGLY MOUNTED ACTUATION CAP

FIELD OF THE INVENTION

The invention relates to an electric switch configuration for installation in a receptacle, whereby the switch can be covered, except for a cutaway portion of the actuation cap, by a shield of the receptacle.

BACKGROUND OF THE INVENTION

For the installation of the switch in the receptacle, especially if several switches are to be installed, tolerances must be provided. In this case, the position of the shield that belongs to the receptacle can be moved by a certain amount relative to the latter. As a consequence, the actuation cap that is framed by the shield must also be moved correspondingly. This is not possible in switches that are commonly used, however, since the actuation cap is again rigidly connected to the switch housing, so that the position of the actuation cap is fixed by the position of the switch.

As a consequence, the size of the shield opening for the actuation cap must be selected correspondingly wide. Another problem is that, especially in the case of illuminated switches, the actuation cap inside the shield opening is offset, which causes this receptacle that is equipped with switches to look wrong.

It is known from DE-OS 42 14 794 to mount the actuation cap in a floating manner relative to the switch housing for the above-mentioned reasons. This means that the position of the actuation cap is able to adapt to the position of the shield opening within certain limits regardless of the position of the switch. In the known switch configuration, the actuation cap is mounted in a floating manner in pins in the switch housing. The cap itself rests with its bottom on an actuation element, so that the cap can act indirectly on the switch via the actuation element. In the known switch configuration, it is disadvantageous that the position areas between the actuation cap and the actuation device, on the one hand, and the actuation cap and the housing, on the other hand, are comparatively far apart, so that when fabrication is done with tolerances, undesirable tilting moments and material stresses can occur. Further, the actuation device is guided in grooves relative to the actuation cap, so that the actuation device cannot be held captive relative to the cap.

Another drawback of the known switch configuration is considered to be the fact that the cap has comparatively large support openings to accommodate the housing pins, whereby the edge area of the support openings is used simultaneously for lateral support of the cap at the shield opening of the shield that surrounds the cap. Due to the relatively large support surfaces of the groove guideway as well as the large support surface of the openings at the shield, movement of the cap is associated with comparatively significant friction.

SUMMARY OF THE INVENTION

The object of the invention is to arrange the actuator in a captive manner relative to the cap and simultaneously to arrange the support positions among the cap, actuator and housing right next to one another to avoid undesirable tilting movements inside the switch.

The object is achieved by the combination of features as recited. The invention thus basically consists in not squeezing the actuator between cap and housing, but rather mounting it directly on the housing. The advantage is that the component via which the switching forces that are directly imparted to the switch is mounted in the housing. Independently of this, provisions are also made to mount the actuation cap relative to the housing.

To have force paths that are as short as possible among cap, actuator and the switch, the combination of features is advisable in further development of the invention. Accordingly, the lever for the force that is imparted via the two bearings is especially short, and the tilting movements produced are comparatively insignificant.

To mount the actuator especially simply and to impart additional torque via the bearing between actuation cap and actuator, is a combination of features advisable in further development of the invention. In principle, it would also be conceivable for the cap to be connected to the actuator via a circular bearing. Torque in the bearing area cannot be imparted to the actuator from the cap in this way, however.

In addition, the catch between actuation cap and actuator is ensured by such a design, since the supports of the actuator which are shaped like a partial circle are preferably located in such a way that they require as little expansion as possible for the overlooking side walls of the actuation cap in the direction of assembly of the two components.

To increase the centering effect during assembly between actuation cap and actuator, the is a combination of features advisable in further development of the invention. Since the cutaway portions of the cap are only partially circular in shape and thus have the shape of, for example, a half ring, material approximately in the shape of a small semicircle remains on the side walls in an extension of the bearing axis of the actuation cap. This can be used advantageously for exploitation of the features. In this way, the friction that is produced can be minimized by attaching the side walls of the cap to the inside wall of the shield opening. On the one hand, namely the tips of the support projections are the extension of the axis of rotation of the actuation cap, so that the projection relative to the shield area executes only rotation, but not pivoting. On the other hand, the support surface of the projection on the shield area is dotlike, also making friction negligibly small.

To simplify assembly between the actuator and the switch housing, is an advisable combination of features. In this case, the procedure should be such that the support openings of the actuator encompass the shaft end of the housing from the outside, so that the actuator can be locked on the shaft end and thus is mounted in a simple way so that it can rotate. Of course, it is also possible for the shaft ends which engage in the corresponding openings of the housing to be placed on the actuator. However, relatively small guide areas are then obtained for the part to be opened out, which can lead to damage to the support location.

An especially simple shape is produced if, the supports are parts of an extending support opening for the actuator. The shaft ends of the housing can thus optionally come to rest on parts of the inside surface of the supports and thus increase the bearing surface. As a result, additional tolerance compensation is also achieved.

To facilitate the locking assembly of the above-mentioned individual parts of the switch, is an advisable combination of features. Accordingly, the components that are to be locked are provided in principle with inclined impact surfaces, which result in the desired opening-out effect. After the opened-out position is achieved, the parts that are to be connected to one another are locked with one another via corresponding undercuts. The inclined impact surfaces are located in this case in such a way that in the direction of assembly, the surfaces that are to be locked with one another are bent out from their original position until they can spring back after reaching their end positions while receiving the corresponding bearing body.

To simplify the mounting of the actuator on the housing, is an advisable combination of features. Accordingly, the force that is required between the actuator and the housing for assembly is reduced, in that the side surfaces of the actuator are given greater elasticity by means of webs, so that it is almost impossible for the actuator to break while being locked on the housing.

In further development of the invention, the combination of features, according to which the actuator is used simultaneously as a reflector for lights that project from the switches that are to be actuated is advisable. In this case, it is advisable to make the actuator preferably out of bright plastic, especially by an injection-molding process.

To increase the brightness in the space between actuator and cap and optionally to provide the cap with injected symbols, is a combination of features advisable in further development of the invention.

To be able to use the same actuator regardless of the design of the cap and to be able to install the actuator in several installation positions, is a combination of features advisable in further development of the invention. Accordingly, the distance that is produced between the bottom and the face of the actuator is also bridged by webs in the bottom of the actuation cap. And at the same time the material thickness of the cap is otherwise left unaffected.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENT

Figure 1:
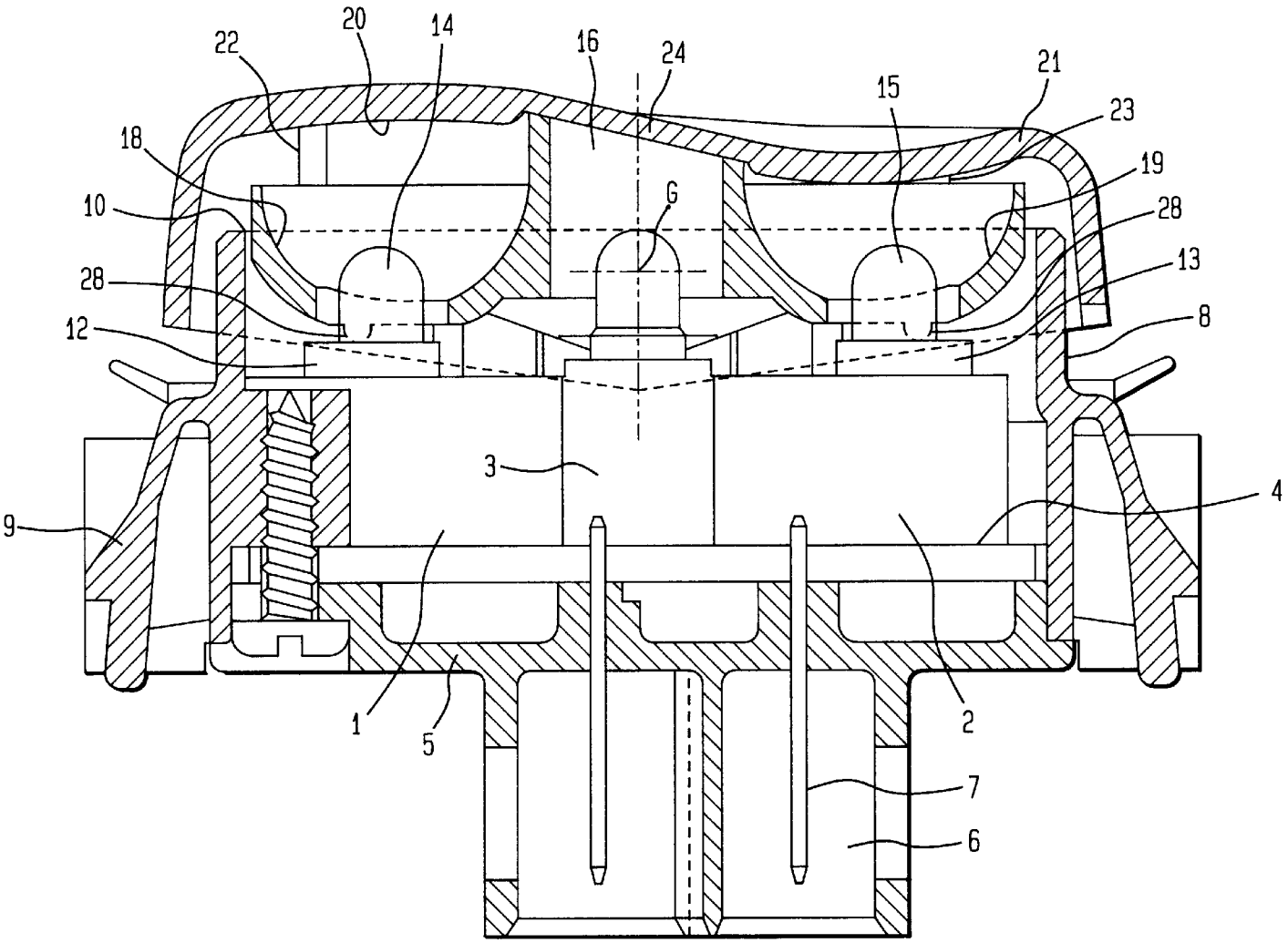
FIG. 1 shows a longitudinal section through a switch configuration according to the invention.

The switch configuration according to FIG. 1 has two switches 1, 2 and optionally a third switch 3, which are mounted on a base plate 4 and are connected electrically. Base plate 4 rests on a connecting plate 5, which has a connector 6 with connecting contacts 7, which are anchored to connecting plate 5 and project through base plate 4 and are connected there to electric lines. These lines then lead in a suitable way to the individual contacts of switches 1, 2 or 3.

Figure 2:
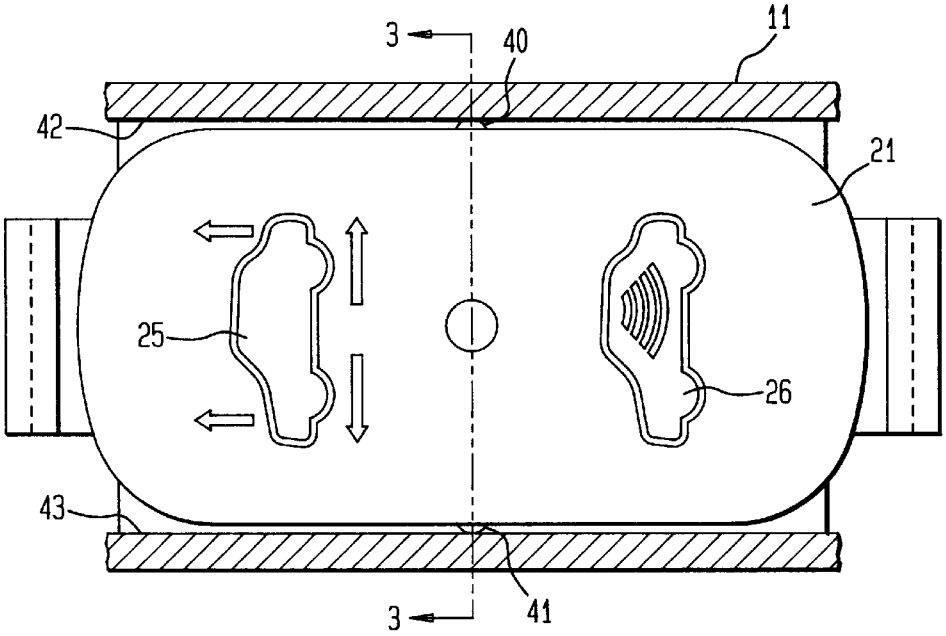
FIG. 2 shows a top view of the switch configuration according to FIG. 1, depicted on a somewhat reduced scale.

A housing 8 is mounted on connecting plate 5 and connected to the latter in a detachable manner. Likewise, base plate 4 is connected in a detachable manner to connecting plate 5 via a screw connection. A housing 8 that is equipped with switches, which can be engaged via locking tags 9 in a receptacle that is not depicted in FIG. 1, is thus obtained. Approximately at the level of upper edge 10 of housing 8, a shield 11 (FIG. 2), which has a shield opening, is held by the receptacle, which, viewed in FIG. 2 from above, covers parts of the switch.

Actuation sleeves 12, 13, which must be depressed to actuate switches 1, 2, are located on switches 1, 2. Light elements 14, 15, which are to facilitate the search for the switch and the recognition of their positions at the respective times, project from the middle of the actuation sleeves.

The switch configuration is additionally provided with an actuator 16, which is mounted to pivot, on the one hand, at point G relative to the housing and is further used so as to be able to act on actuation sleeves 12, 13, which is accomplished with the aid of the depending tips 27, 28 located on the bottom surfaces of reflectors 18, 19 that are part of actuator 16. Reflectors 18, 19 have openings through which light elements 14, 15 project and provide for the lighting of bottom surface 20 of an actuation cap 21. Actuation cap 21 acts via cross webs 22, 23 on actuator 16, by virtue of the fact that in FIG. 1 the cross webs engage at the faces of reflectors 18, 19 perpendicular to the plane of the observer. In addition, center area 24 of actuation cap 16 rests on a section of actuator 16 that is configured in the shape of a lattice.

Figure 3:
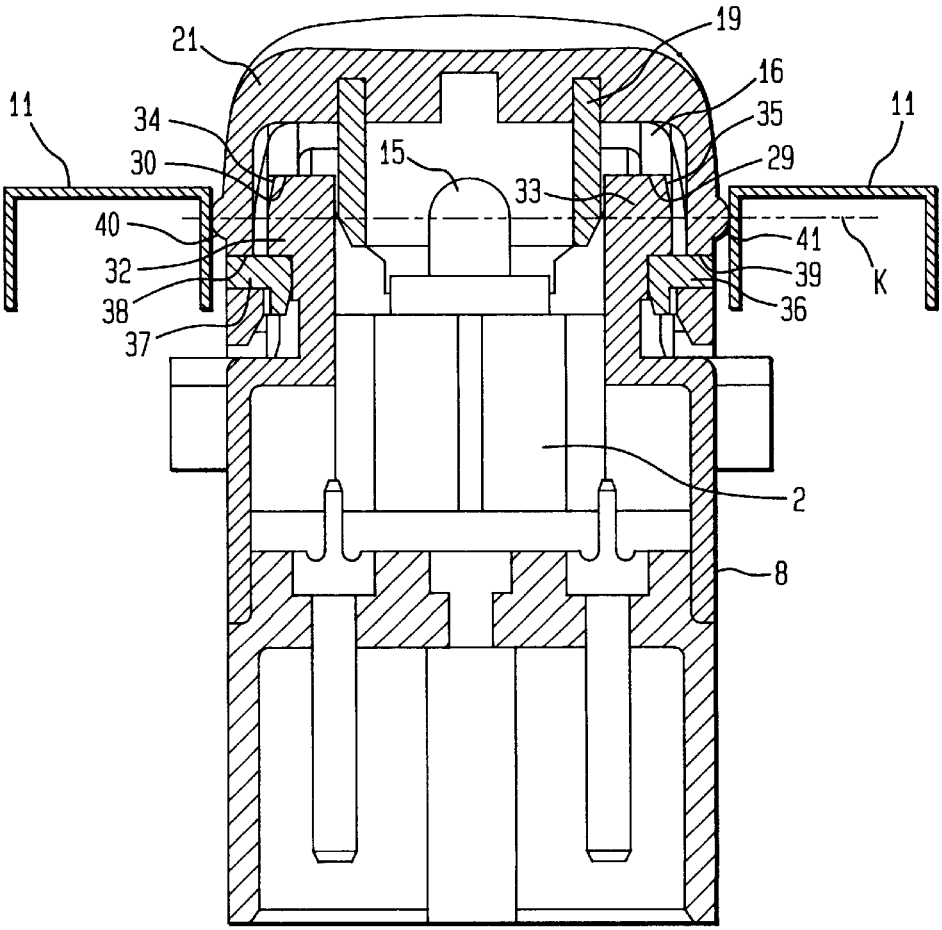
FIG. 3 shows a section along, for example, line 3—3 in FIG. 2.

The mounting between housing 8, actuator 16 and cap 21, which is shown most clearly in FIG. 3, is now especially important to the invention.

FIG. 3 shows cap 21 and a part of reflector 19, into which light element 15 projects.

At the level of longitudinal axis K that penetrates point G in FIG. 1 perpendicular to the plane of the observer, actuator 16 has two support openings 29, 30, which are aligned with one another, in which corresponding shaft ends 32, 33 of the housing engage. To facilitate engagement, shaft ends have inclined impact surfaces 34, 35, to which correspond inclined surfaces of actuator 16.

Half-shell-shaped support projections 36, 37, which essentially have the shape of a half ring in section, extend outward from support openings 29, 30. These half shells project through corresponding openings 38 and 39 of cap 21. Projections 36, 37 that form the support projections penetrate corresponding arc-shaped cutaway portions 38, 39 in cap 21, whereby these are segments of a circular arc, preferably a half-arc in the shape of a circle.

Two hemispherical projections 40, 41, which extend from the actuation cap 21, are provided on each side of the cap. The actuation cap that is mounted in a floating manner in the direction of bearing axis K via projections 36, 37 of actuator 16 is supported with projections 40, 41 on inside surfaces 42, 43 of the shield, which surrounds actuation cap 21. Accordingly, actuation cap 21, independently of the position of housing 8 relative to shield 11, is always aligned exactly symmetrically with respect to inner surfaces 42, 43.

The present invention may be embodied in other specific forms without departing from the spirit or essential attributes therefore and, accordingly, references should be made to appended claims, rather than to the foregoing specification, as indicating the scope of the invention.

We claim:

1. An electric switch configuration comprising:

a housing;

at least one switch carried in the housing;

an activating sleeve coupled to said switch;

an actuator rotatably mounted to the housing about a bearing axis and acting directly on the activating sleeve, the actuator having at least one recess for receiving the housing and having at least two projections; and an actuation cap having at least two cutaway portions for receiving the at least two projections of the actuator, wherein the actuation cap is mounted on the at least two projections and is rotatable relative to the actuator.

2. The electric switch configuration of claim 1 wherein the at least two projections are semi-circular shaped.

3. The electric switch configuration of claim 2 wherein the at least two cutaway portions correspond in shape to the at least two projections.

4. The electric switch configuration of claim 3 wherein the at least one recess is inclined.

5. The electric switch configuration of claim 4 wherein the housing has inclined shaft ends which engage in a locking manner with the at least one inclined recess of the actuator.

6. An electric switch configuration comprising:

a housing;

at least one switch carried in the housing;

switch activating means located on said switch;

an actuator rotatably mounted to the housing about a bearing axis and acting directly on the switch activating means, the actuator having at least one recess for receiving the housing, and having at least two projections;

an actuation cap having at least two cutaway portions and at least two support projections, the cutaway portions configured to receive the at least two projections of the actuator, the at least two support projections extend from the actuation cap thereby extending the axis of rotation from the bearing axis, wherein the actuation cap is mounted on the at least two projections and is rotatable relative to the actuator; and a shield surrounding the actuation cap, wherein the actuator is supported by the at least two support projections on the shield for rotation, and wherein said actuation cap is rotatable independent of the position of the housing.

7. The electric switch configuration of claim 6 wherein the at least two support projections are hemispherically shaped.

8. The electric switch configuration of claim 7 wherein said actuator further comprises a reflector for lights, wherein the reflector forms a support surface on the switch activating means.

9. The electric switch configuration of claim 8 wherein said actuator is composed of a suitable plastic for reflecting light.

10. The electric switch configuration of claim 9, wherein said actuator cap has symbols located thereon.

11. An electric switch configuration comprising:

a housing;

at least one switch carried in the housing;

switch activating means located on said switch;

an actuator rotatably mounted to the housing about a bearing axis and acting directly on the switch activating means, the actuator having at least one recess for receiving the housing, and having at least two projections and at least two cross webs;

an actuation cap having at least two cutaway portions for receiving the at least two projections of the actuator, wherein the actuation cap is mounted on the at least two projections and is rotatable relative to the actuator; and wherein the actuation cap acts via the at least two cross webs on the switch activating means.

12. The electric switch configuration of claim 11 wherein the at least two projections are semi-circular shaped.

13. The electric switch configuration of claim 12 wherein the at least two cutaway portions correspond in shape to the at least two projections.

14. The electric switch configuration of claim 13 wherein the at least one recess is inclined.

15. The electric switch configuration of claim 14 wherein the housing has inclined shaft ends which engage in a locking manner with the at least one inclined recess of the actuator.

16. The electric switch configuration of claim 15 wherein the at least two support projections are hemispherically shaped.

17. The electric switch configuration of claim 16 wherein said actuator further comprises a reflector for lights, wherein the reflector forms a support surface on the switch activating means.

18. The electric switch configuration of claim 17 wherein said actuator is composed of a suitable plastic for reflecting light.

19. The electric switch configuration of claim 18, wherein said actuator cap has symbols located thereon.

20. The electric switch configuration of claim 19, wherein said actuator further comprises at least one depending tip for engaging the switch activating means.

* * * * *